United States Patent [19]

Feldhoff et al.

[11] 4,429,664

[45] Feb. 7, 1984

[54] COOLED SHAKING GRATE HAVING NO GRATE BAR

[75] Inventors: Karl Feldhoff, Marienheide; Paul Peters, Gummersbach, both of Fed. Rep. of Germany

[73] Assignee: L. & C. Steinmüller GmbH, Gummersbach, Fed. Rep. of Germany

[21] Appl. No.: 446,710

[22] Filed: Dec. 3, 1982

[30] Foreign Application Priority Data

Dec. 8, 1981 [DE] Fed. Rep. of Germany ..... 3148446

[51] Int. Cl.[3] ..... F22B 31/00; F23K 3/08

[52] U.S. Cl. ..... 122/376; 110/243; 110/248; 110/268

[58] Field of Search ..... 122/374, 375, 376; 110/281–284, 268, 313, 243, 248

[56] References Cited

U.S. PATENT DOCUMENTS

| | | | |
|---|---|---|---|
| 955,388 | 4/1910 | Crosthwaite | 122/376 |
| 1,223,830 | 4/1917 | Reagan | 110/281 |
| 1,585,449 | 5/1926 | Welsh | 122/375 |
| 1,775,790 | 9/1930 | Tawlks | 122/374 |
| 2,257,957 | 10/1941 | Hofft et al. | 122/376 |
| 2,763,220 | 9/1956 | Becker et al. | 110/192 |
| 3,014,439 | 12/1961 | Mitchell et al. | 110/268 |
| 3,393,652 | 7/1968 | Connell | 122/376 |
| 3,444,831 | 5/1969 | Pearl | 110/268 |
| 4,233,024 | 11/1980 | Plass | 110/243 |
| 4,356,778 | 11/1982 | McRee, Jr. | 110/248 |

*Primary Examiner*—Henry C. Yuen

*Attorney, Agent, or Firm*—Becker & Becker, Inc.

[57] ABSTRACT

A shaking grate having inclined continuous tubes disposed parallel to the direction of incline and communicating with a liquid or fluid coolant circuit. The tubes are arranged on a vibrating grate carriage. The shaking grate is made free of grate bars by means of a planar tube-crosspiece-tube grate sheet construction, with the tube crosspieces having slot-shaped openings which are conically tapered in the direction of the fuel bed. The shaking grate is free of slots in the region of the fuel bed inlet as far as to the beginning of the first combustion zone of the fuel bed. The shaking grate is connected with crossbars of the vibrating grate carriage via ridge or comb plates and heat-compensating gliding elements. The shaking grate is provided with a riser for the draining liquid or fluid coolant. The riser is arranged in the charging region of the fuel bed inlet.

1 Claim, 5 Drawing Figures

COOLED SHAKING GRATE HAVING NO GRATE BAR

BACKGROUND OF THE INVENTION

The present invention relates to a shaking grate having inclined continuous tubes disposed parallel to the direction of incline and communicating with a liquid or fluid coolant circuit; the tubes are arranged on a vibrating grate carriage.

German Pat. No. 841,616, and U.S. Pat. No. 2,763,220, describe a tube element of a continuous shaking grate, the grate sheet of which consists of tubes having a coolant flowing therethrough and disposed parallel to one another in the conveying or feeding direction of the fuel. The individual tubes extend continuously from the beginning of the grate to the end of the grate, are inclined to the end of the grate, and covered against the high thermal and mechanical stresses with cast-iron grate bars which space them apart.

The disadvantage of this type of grate is that a heat-conducting paste is introduced between the grate bar and cooling tube for an adequate cooling of the grate bars by the tube, through which coolant flows. This paste must fill the charging chamber in such a way as to be free of gaps, must not lose its effect at temperatures greater than 400° C. during solidification or hardening and by tear or crack formation in changing system operation, and must have sufficient corrosion resistance against physical and chemical attack.

A further disadvantage is the costly construction, fabrication, and assembly. A controlled or regulated distribution of the air for combustion, and a construction of the tubes free of transverse force, is not assured despite the use of calibrated precision steel tubes, for example according to DIN (German Industrial Norm) 2391 despite a high mechanical machining cost of the cast grate bars, and despite considerable care during placement of the dish-shaped, cast-iron grate bars, which are keyed or wedged on.

A similar situation exists for the shaking grates disclosed by U.S. Pat. No. 3,263,655. These shaking grates consist of planar grate sheets which are water cooled, overlap one another, and are assembled in a ladder shape. The tubes which form the crossbars are placed between the side walls of the combustion chamber, while the tubes which form the rungs are covered by grate bars placed and fastened to the underside by means of a strip; such grate bars have openings of T-shaped cross section for the combustion air, and are provided with curvatures adapted to the tube shape.

It is therefore an object of the present invention to develop a shaking grate of the initially described general type which eliminates the cast iron grate covering and uses standard boiler tubes, for example according to DIN 2448, yet is not only simple to construct, fabricate, and assemble, but also ensures a controlled feed and distribution of the air for combustion for the fuel bed which rests on the shaking grate.

BRIEF DESCRIPTION OF THE DRAWINGS

This object, and other objects and advantages of the present invention, will appear more clearly from the following specification in connection with the accompanying drawings, in which.

SUMMARY OF THE INVENTION

The shaking grate of the present invention is characterized primarily in that it is:

(a) made free of grate bars by means of a planar tube-crosspiece-tube grate sheet construction, with the tube crosspieces having slot-shaped passages or openings which are tapered conically in the direction of the fuel bed;

(b) free of slots in the region of the fuel bed inlet as far as to the beginning of the first combustion zone of the fuel bed;

(c) connected via ridge or comb plates and heat-compensating glide elements with crossbars of the vibrating grate carriage; and (d) provided with a riser for the draining fluid or liquid coolant; the riser is situated in the charging region of the fuel bed inlet.

DESCRIPTION OF THE PREFERRED EMBODIMENT

Figure 1:
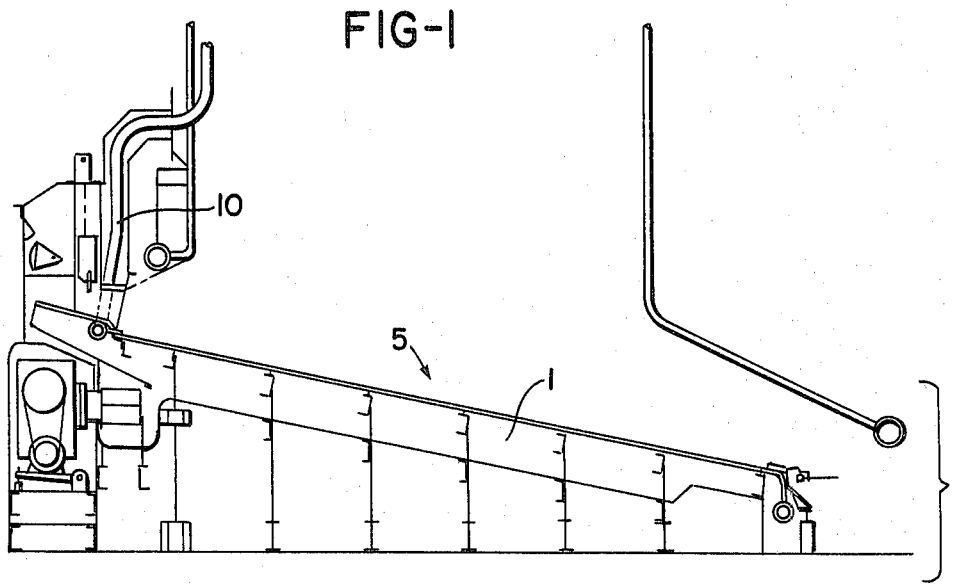
FIG. 1 is a side view of one embodiment of the entire shaking grate according to the present invention.
Figure 2:
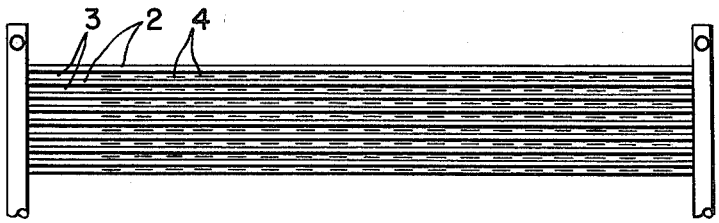
FIG. 2 is a plan view of the shaking grate illustrated in FIG. 1.
Figure 3:
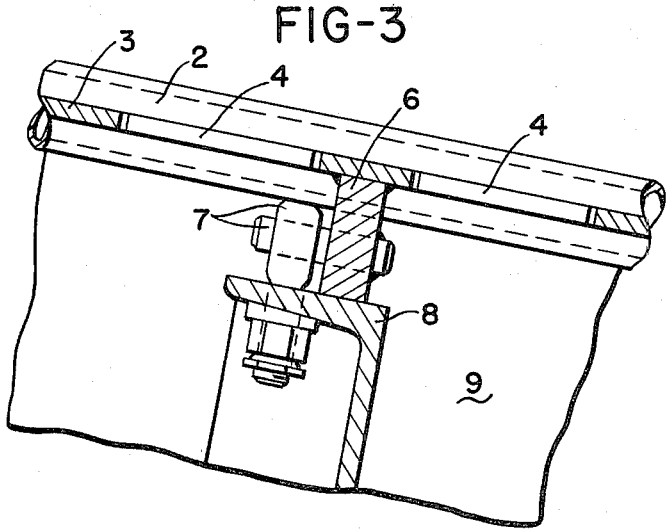
FIG. 3 is a cutaway portion of the shaking grate illustrated in FIG. 1.
Figure 4:
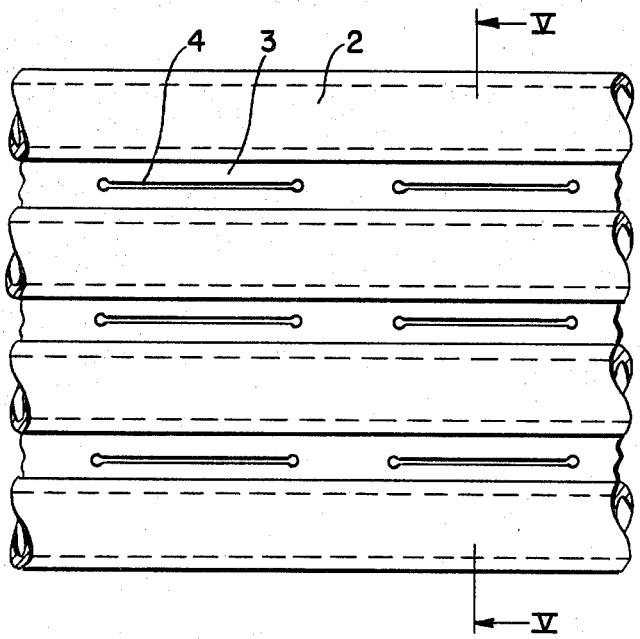
FIG. 4 is a plan view of the cutaway portion illustrated in FIG. 3.
Figure 5:
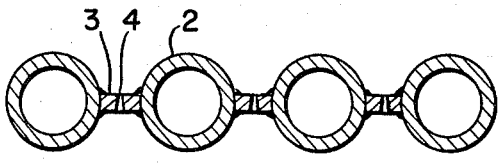
FIG. 5 is a view along line V—V in FIG. 4.

Referring now to the drawings in detail, the shaking grate 1, which does not have a rake or grate bar, is welded into a planar grate sheet of alternate tube-crosspiece-tube; the inclined tubes 2 are continuously incorporated into the liquid or fluid cooling circuit. The tubes 2 rest upon a grate carriage parallel to the direction of incline. The tube crosspieces 3 are provided with slot-shaped passages or openings 4 which are conically tapered in the direction of the fuel bed 5. These openings 4 are introduced or formed in one operation, without machining or finishing, in the crosspiece 3, for example by means of special torches equipped with twin-jet nozzles. The planar grate sheet has no slots in the region of the inlet and as far as to the beginning of the first combustion zone of the fuel bed 5. The grate sheet of the shaking grate 1 is connected with the crossbars 8 of the vibrating grate carriage 9 via ridge or comb plates 6 and heat-compensating glide elements 7. The grate sheet is provided with a riser 10 (FIG. 1) for the draining liquid or fluid coolant; the riser 10 is located in the charging region of the inlet of the fuel bed.

The present invention has several advantages. The elimination of a cast iron grate bar covering makes it unnecessary to have a costly mechanical machining of the grate bars, and makes it unnecessary to have their assembly via keying, which leads to unavoidable transverse forces within the grate sheet. Thus, it is possible to use standard seamless steel tubes in place of expensive precision steel tubes. Also saved is the use of a heat-conducting paste, the action of which is not always assured due to the high temperature loading.

The tube-crosspiece-tube construction into a planar grate sheet also permits narrower spacing between tubes, and permits a uniform cooling of the entire grate sheet. In conjunction with the tube spacing, the conical passages or openings are closer to one another than was the case with heretofore known approaches. The smaller spacing of the selected openings makes it possible to very precisely dose the air volume flow which is needed for the combustion, and to distribute such air volume flow over the fuel bed, as a result of which, in conjunction with the shaking motion of the grate, which effects a loosening of the fuel bed, the fuel combustion is increased and the exhaust gas loss is reduced. At the same time, the grate sheet is more uniformly acted upon by the fuel heat that is released.

The gliding support of the grate sheet upon the grate carriage avoids the occurrence of stresses within the grate sheet as a consequence of thermal expansion.

The relocation or placement of the riser 10 for the draining liquid or fluid coolant in the charging region of the fuel bed inlet, and from here into the combustion chamber, offers a structurally advantageous approach compared with the previously embodied conduit guidance into the combustion chamber below the inlet cover.

The present invention is, of course, in no way restricted to the specific disclosure of the specification and drawings, but also encompasses any modifications within the scope of the appended claim.

What we claim is:

1. A shaking grate for a fuel bed, said shaking grate having an inlet with a charging region for said fuel bed and including:

a vibrating grate carriage which is provided with crossbars;

a planar grate sheet comprising alternatingly, inclined and interconnected tubes and crosspieses; said tubes being continuous and being disposed parallel to the direction of incline; said crosspieces having slot-shaped openings which taper conically in the direction of said fuel bed, said crosspieces being free of said openings in the region of said inlet for said fuel bed and up to the beginning of the first combustion zone of said fuel bed;

ridge plates and heat-compensating glide elements for connecting said grate sheet to said crossbars of said grate carriage;

a coolant circuit with which said tubes communicate; and a riser for coolant, said riser being situated in said charging region of said inlet for said fuel bed.

* * * * *